US009821552B2

(12) United States Patent
Yokoyama et al.

(10) Patent No.: US 9,821,552 B2
(45) Date of Patent: Nov. 21, 2017

(54) LIQUID-TOLERANT LIQUID DROPLET EJECTING APPARATUS

(71) Applicant: TOSHIBA TEC KABUSHIKI KAISHA, Tokyo (JP)

(72) Inventors: Shuhei Yokoyama, Mishima Sizuoka (JP); Satoshi Kaiho, Yokohama Kanagawa (JP); Ikuo Fujisawa, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/213,069

(22) Filed: Jul. 18, 2016

(65) Prior Publication Data

US 2017/0165969 A1 Jun. 15, 2017

(30) Foreign Application Priority Data

Dec. 11, 2015 (JP) ..... 2015-242263

(51) Int. Cl.
*B41J 2/14* (2006.01)
*B41J 2/045* (2006.01)

(52) U.S. Cl.
CPC ..... *B41J 2/14* (2013.01); *B41J 2/14032* (2013.01); *B41J 2/14201* (2013.01); *B41J 2/04541* (2013.01); *B41J 2/04581* (2013.01); *B41J 2002/14491* (2013.01)

(58) Field of Classification Search
CPC ..... B41J 2/14; B41J 2/14032; B41J 2/14201; B41J 2002/14491; B41J 2/04541; B41J 2/04581
See application file for complete search history.

(56) References Cited

U.S. PATENT DOCUMENTS 9,539,814 B2 * 1/2017 Chen ..... B41J 2/14
2010/0261611 A1 10/2010 Peters
2014/0063131 A1 * 3/2014 Arai ..... B41J 2/14233 347/71
2014/0193309 A1 7/2014 Still et al.

* cited by examiner

*Primary Examiner* — Manish S Shah
*Assistant Examiner* — Yaovi M Ameh
(74) *Attorney, Agent, or Firm* — Patterson & Sheridan, LLP

(57) ABSTRACT

A liquid droplet ejecting apparatus includes a liquid container, a liquid ejection chip that is fixed to a lower surface of the liquid container to receive liquid from the liquid container, and includes a pressure chamber formed therein, a nozzle to eject liquid from the pressure chamber, and an actuator disposed adjacent to the nozzle, a base member having an opening at which the liquid container is fixed such that the nozzle is exposed on a lower surface of the base member, and a circuit substrate fixed to a lower side of the base member and including a wiring electrically connected to the actuator on a lower surface of the circuit substrate.

11 Claims, 10 Drawing Sheets

LIQUID-TOLERANT LIQUID DROPLET EJECTING APPARATUS

CROSS-REFERENCE TO RELATED APPLICATION

This application is based upon and claims the benefit of priority from Japanese Patent Application No. 2015-242263, filed Dec. 11, 2015, the entire contents of which are incorporated herein by reference.

FIELD

Embodiments described herein relate generally to a liquid droplet ejecting apparatus.

BACKGROUND

In research and development, medical diagnosis and examination, and agricultural testing in fields such as biology and pharmaceutical sciences, liquid from picoliters (pL) to microliters (μL) is dispensed to each of different subjects. For example, an operation to dispense small volumes of liquid is carried out to determine effective concentration of a chemical compound that attacks cancer cells.

Such an operation is generally referred to as a dosage response experiment, and during the operation, a chemical compound of a large number of different concentrations is prepared in containers such as wells of a microplate in order to determine effective concentrations of the chemical compound. An on-demand type liquid droplet ejecting apparatuses is used for that operation. For example, the liquid droplet ejecting apparatus includes a solution container, a nozzle that discharges the solution, a pressure chamber that is disposed between the solution container and the nozzle, and an actuator that controls pressure of the solution in the pressure chamber.

According to such a liquid droplet ejecting apparatus, the amount of liquid of a single droplet that is discharged from the nozzle is of the order of picoliters, and it is possible to drip amounts of a liquid of an order of picoliters to microliters into each well by controlling the number of times of dripping. Therefore, the liquid droplet ejecting apparatus is suitable for dispensing compounds of a large number of different concentrations, by minute amounts from pL to nanoliters (nL) and microliters (μL).

DETAILED DESCRIPTION

In general, according to an embodiment, a liquid droplet ejecting apparatus includes a liquid container, a liquid ejection chip that is fixed to a lower surface of the liquid container to receive liquid from the liquid container, and includes a pressure chamber formed therein, a nozzle to eject liquid from the pressure chamber, and an actuator disposed adjacent to the nozzle, a base member having an opening at which the liquid container is fixed such that the nozzle is exposed on a lower surface of the base member, and a circuit substrate fixed to a lower side of the base member and including a wiring electrically connected to the actuator on a lower surface of the circuit substrate.

First Embodiment

Figure 1:
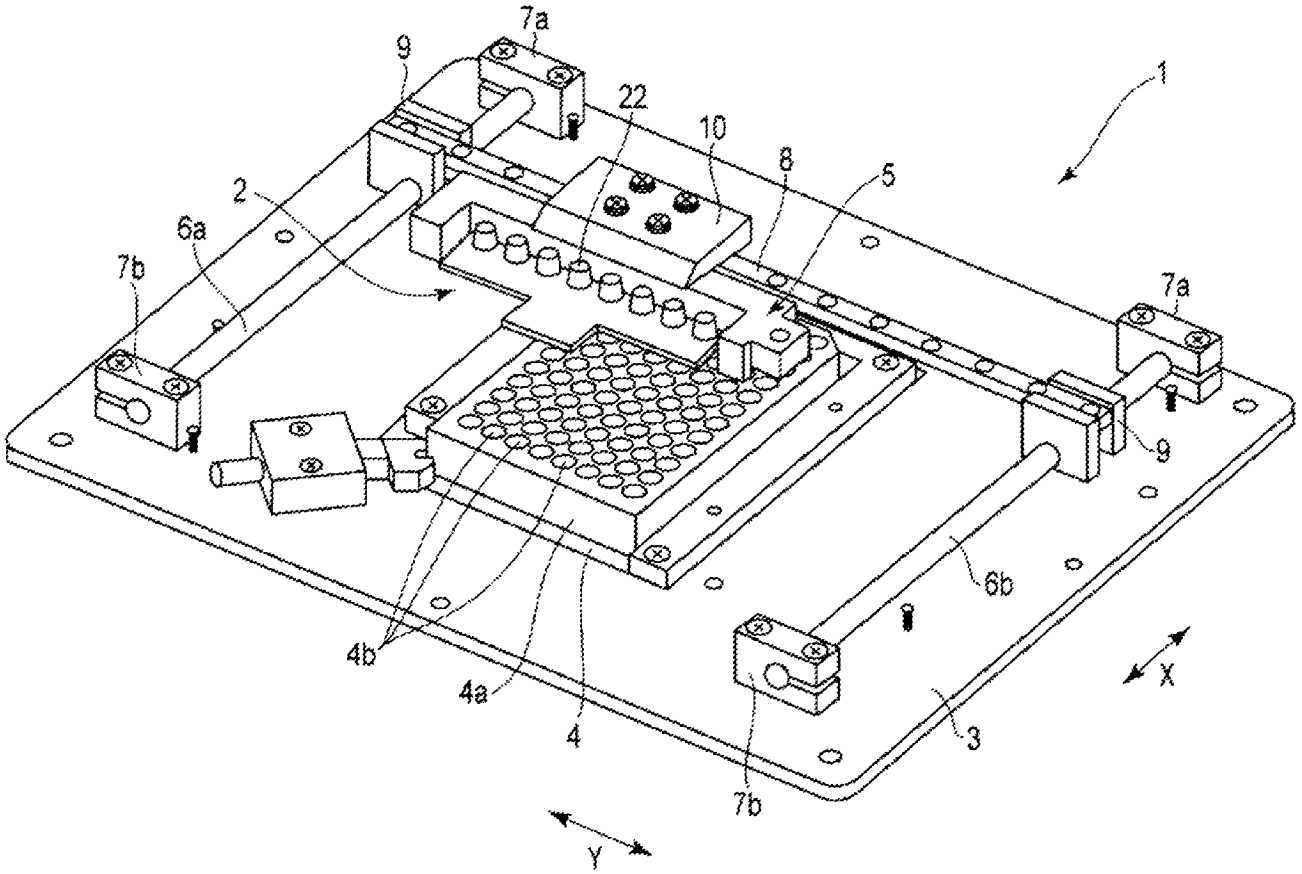
FIG. 1 is a perspective view of a solution dripping apparatus in which a liquid droplet ejecting apparatus according to a first embodiment is mounted.
Figure 2:
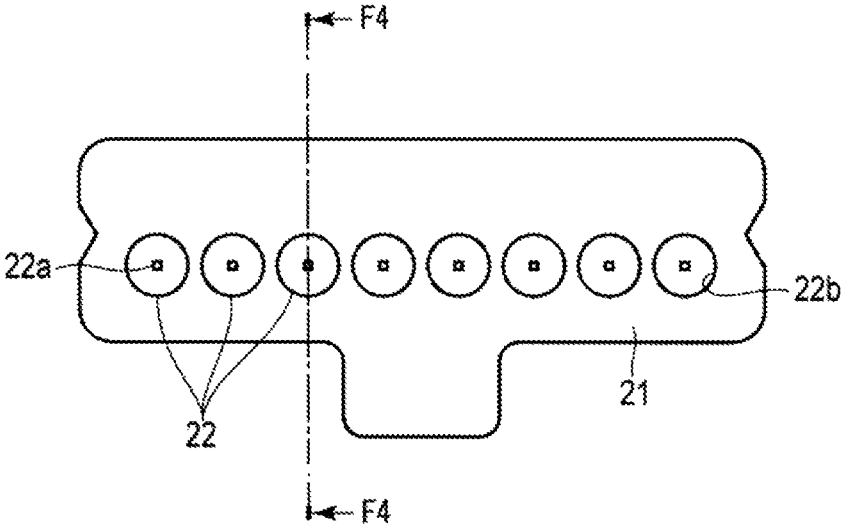
FIG. 2 is a plan view of an upper surface of the liquid droplet ejecting apparatus according to the first embodiment.
Figure 3:
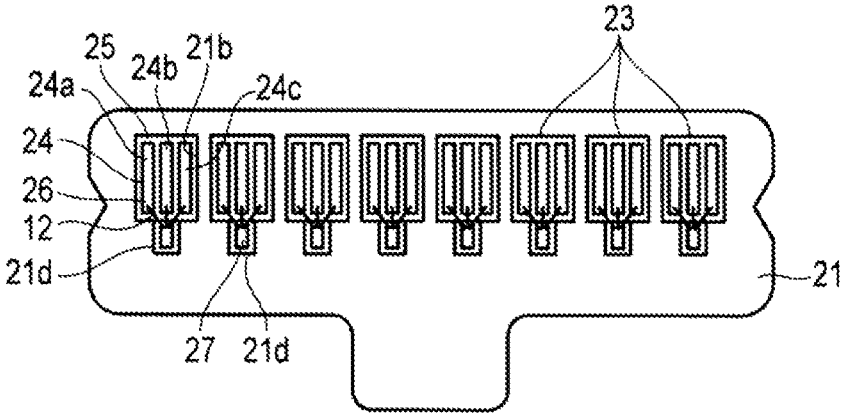
FIG. 3 is a plan view of a lower surface of the liquid droplet ejecting apparatus according to the first embodiment.
Figure 4:
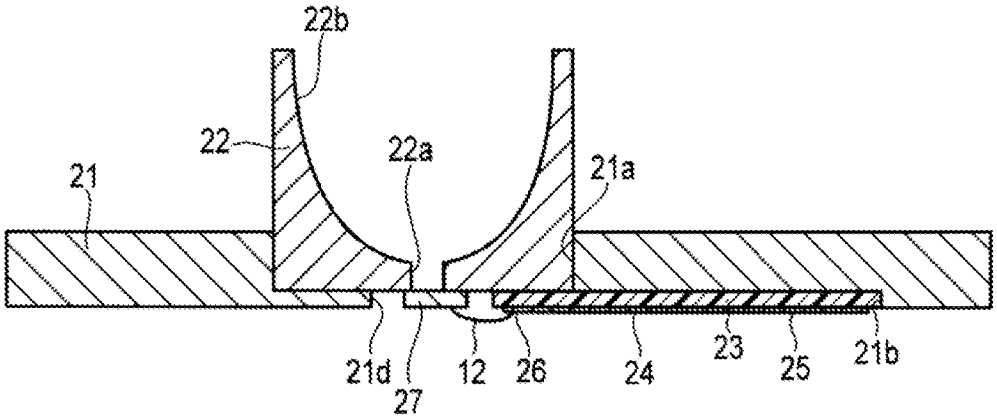
FIG. 4 is a cross-sectional view of the liquid droplet ejecting apparatus taken along a line F4-F4 in FIG. 2.
Figure 5:
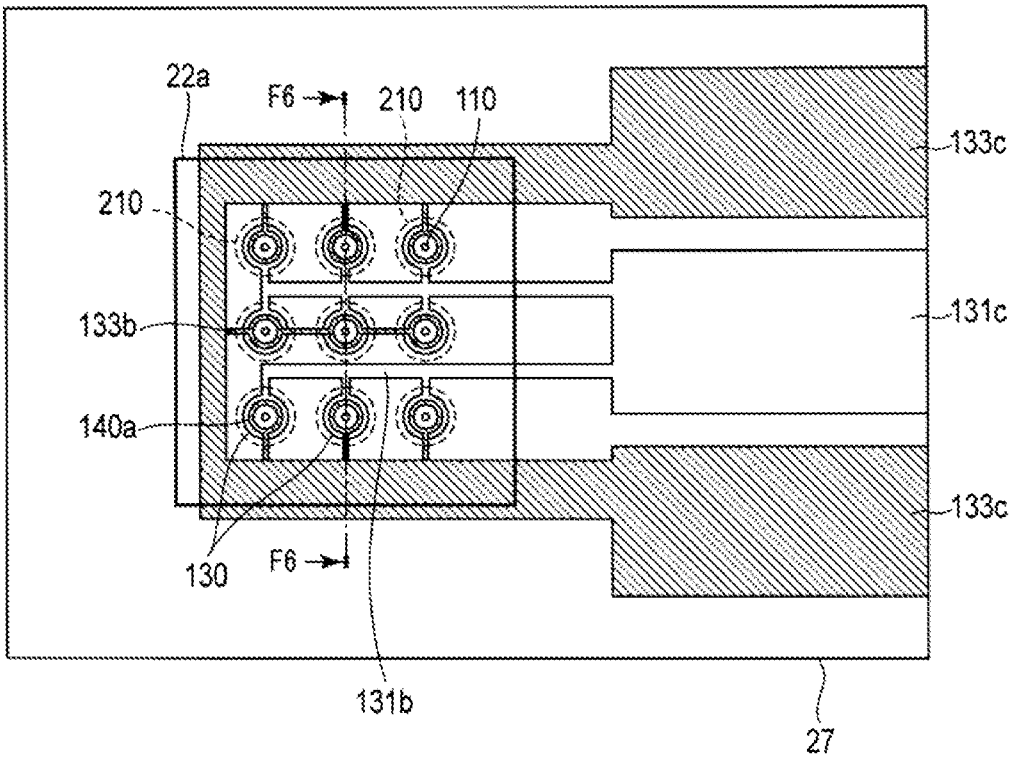
FIG. 5 is a plan view of a liquid droplet ejection array of the liquid droplet ejecting apparatus of the first embodiment.
Figure 6:
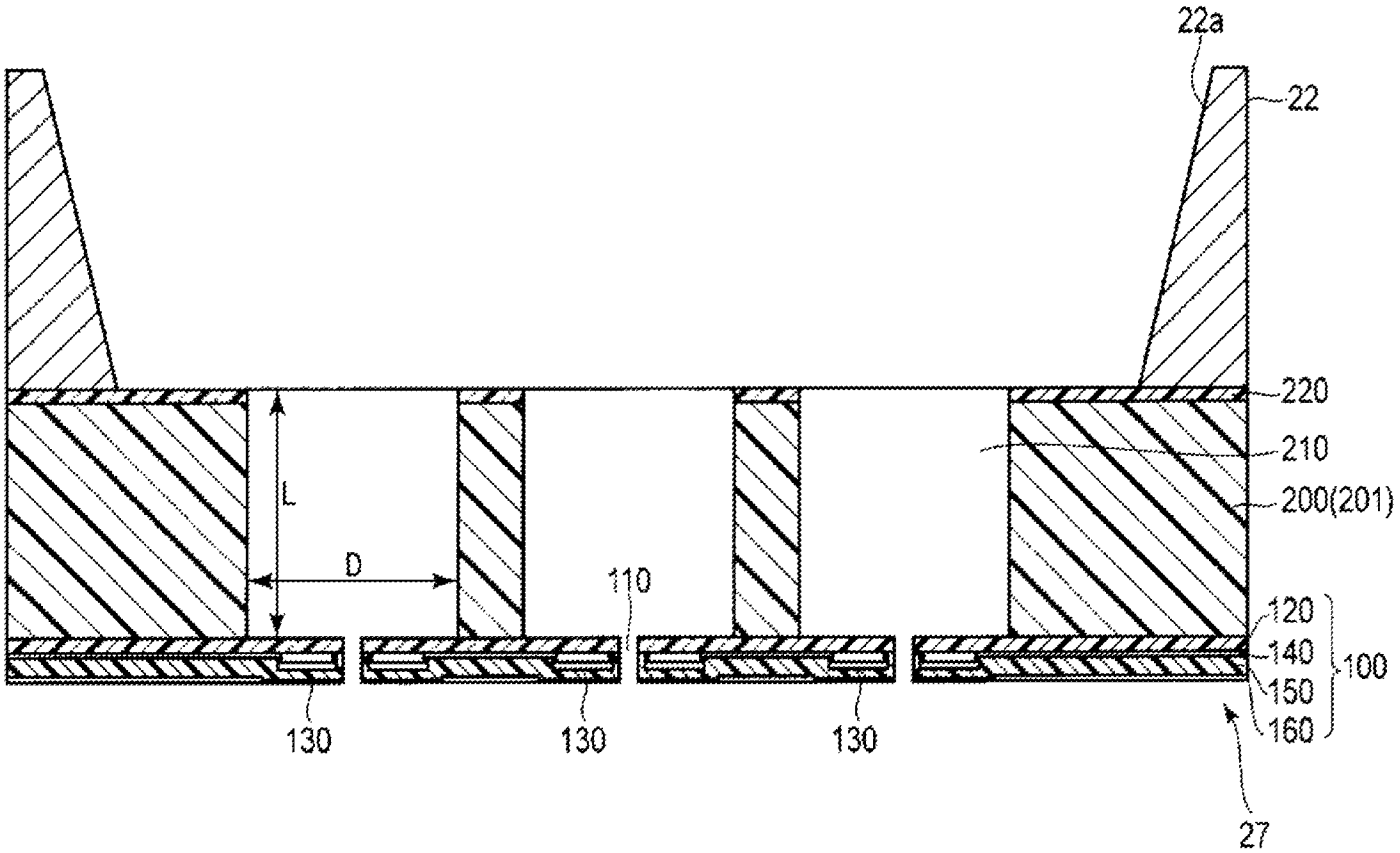
FIG. 6 is a cross-sectional view of the liquid droplet ejection array taken along a line F6-F6 in FIG. 5.
Figure 7:
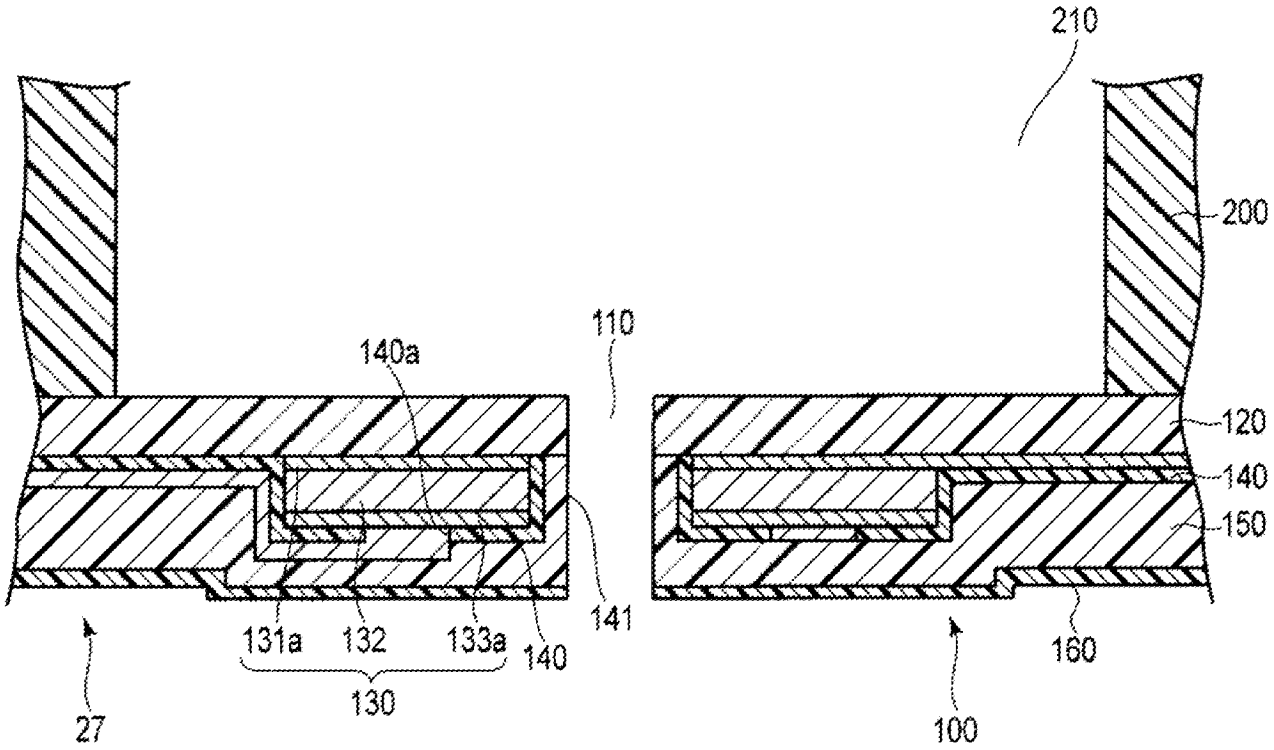
FIG. 7 is a cross-sectional view of a nozzle of the liquid droplet ejecting apparatus according to the first embodiment.

An example of a liquid droplet ejecting apparatus according to a first embodiment will be described with reference to FIGS. 1 to 7. FIG. 1 is a perspective view of a liquid droplet ejecting apparatus 2 of the first embodiment, which is used in a solution dripping apparatus 1. FIG. 2 is an upper plan view of the liquid droplet ejecting apparatus 2, and FIG. 3 is a lower plan view of the liquid droplet ejecting apparatus 2, showing a surface at which liquid droplets are ejected. FIG. 4 is a cross-sectional view of the liquid droplet ejecting apparatus 2 taken along a line F4-F4 in FIG. 2. FIG. 5 is a plan view of a liquid droplet ejection array 27 (liquid ejection chip 27) of the liquid droplet ejecting apparatus 2 according to the first embodiment. FIG. 6 is a cross-sectional view of the droplet ejection array 27 taken along a line F6-F6 in FIG. 5. FIG. 7 is an enlarged cross-sectional view of a nozzle 110 of the liquid droplet ejection array.

The solution dripping apparatus 1 includes a base platform 3 having a flat-plate shape, and a liquid droplet ejecting apparatus mounting module 5. In the present embodiment, a solution is filled into a 96-hole microplate 4 that is generally used in analysis, clinical examination, and the like, in the biochemical field.

The microplate 4 is fixed at a central position of the base platform 3. A pair of left and right X-direction guide rails 6*a* and 6*b*, which extend in the X direction on both sides of the microplate 4, is disposed on the base platform 3. Both end portions of each X-direction guide rail 6*a* and 6*b* are fixed to fixing platforms 7*a* and 7*b*, which are provided on the base platform 3 in a protruding manner.

A Y-direction guide rail 8, which extends in the Y direction, is provided between the X-direction guide rails 6*a* and 6*b* in a hanging manner. Both ends of the Y-direction guide rail 8 are respectively fixed to X-direction movement platforms 9 that are capable of sliding in the X direction along the X-direction guide rails 6*a* and 6*b*.

A Y-direction movement platform 10 that enables the liquid droplet ejecting apparatus mounting module 5 to move in the Y direction along the Y-direction guide rail 8, is provided on the Y-direction guide rail 8. The liquid droplet ejecting apparatus mounting module 5 is mounted on the Y-direction movement platform 10. The liquid droplet ejecting apparatus 2 of the present embodiment is fixed to the liquid droplet ejecting apparatus mounting module 5. As a result, the liquid droplet ejecting apparatus 2 is capable of moving to arbitrary positions in the orthogonal X and Y directions as a result of a combination of moving of the Y-direction movement platform 10 in the Y direction along the Y direction guide rail 8, and moving of the X-direction movement platforms 9 in the X direction along the X-direction guide rails 6*a* and 6*b*.

The liquid droplet ejecting apparatus 2 of the first embodiment includes a base member 21 having a flat plate shape. As shown in FIG. 2, a plurality of solution containers 22 (liquid containers 22), eight in the present embodiment, are arranged in a single row in the Y direction on a front surface side of the base member 21. As shown in FIG. 4, the solution containers 22 have cylindrical outer surfaces and are open upward. Cylindrical recessed portions 21*a* are formed on a front surface side of the base member 21 at positions that correspond to the solution containers 22. Bottom portions of the solution containers 22 are fixed to the cylindrical recessed portions 21*a*. Furthermore, openings 22*a*, which are solution outlets, are formed in the bottom portions of the solution containers 22 at central positions. Opening areas of upper surface openings 22*b* are larger than opening areas of the openings 22*a* of the solution outlets.

As shown in FIG. 3, the same number of electric substrates (circuit substrate) 23 as the solution containers 22 are arranged in a single row in the Y direction on the rear surface side of the base member 21. The electric substrates 23 are rectangular flat plate members. As shown in FIG. 4, rectangular recessed portions 21*b* for mounting the electric substrates 23, and liquid droplet ejection array openings 21*d*, which are in communication with the recess portions 21*b*, are formed on the rear surface side of the base member 21. The rectangular recessed portions 21*b* extend up to an upper end section position (a right end section position in FIG. 4) of the base member 21 in FIG. 3. As shown in FIG. 4, the rectangular recessed portions 21*b* extend up to positions corresponding to the openings 22*a* of the solution containers 22. The electric substrates 23 are fixed to the rectangular recessed portions 21*b*.

Wiring 24 is formed in a pattern on a surface of the electric substrates 23 that is opposite to a surface fixed to the recess portions 21*b*. Three wiring patterns 24*a*, 24*b*, and 24*c*, which are respectively connected to a terminal portion 131*c* of a lower electrode 131 and two terminal portions 133*c* of an upper electrode 133 are formed on the wiring 24.

An input terminal 25 for inputting a control signal from an external device is formed at one end of the electric substrate wiring 24. An electrode terminal connection portion 26 is provided at the other end of the wiring 24. The electrode terminal connection portion 26 is a connection portion for connecting to the terminal portion 131*c* of the lower electrode 131 and the two terminal portions 133*c* of the upper electrode 133 that are formed on the liquid droplet ejection array 27, which is shown in FIG. 5 and will be described below.

In addition, through-holes of the liquid droplet ejection array opening 21*d* are provided in the base member 21. As shown in FIG. 3, the liquid droplet ejection array opening 21*d* is formed as a rectangular opening on the rear surface of the base member 21 at a position that overlaps the recess portion 21*a*.

As shown in FIG. 5, the liquid droplet ejection array 27, which covers the opening 22*a* of the solution container 22, is fixed to the lower surface of the solution container 22. The liquid droplet ejection array 27 is disposed at a position that corresponds to the liquid droplet ejection array opening 21*d* of the base member 21.

As shown in FIG. 6, the liquid droplet ejection array 27 is formed of a stack of a nozzle plate 100 and a pressure chamber structure 200. A plurality of nozzles 110, each of which is an opening in the nozzle plate 100 that discharges a solution from a corresponding pressure chamber, is formed in the nozzle plate 100. As shown in FIG. 5, in the present embodiment, the plurality of nozzles 110 is arranged in the nozzle plate 100 in 3 columns×3 rows, for example. A center-to-center spacing of adjacent nozzles 110 of the nozzle plate 100 is set at 250 μm in this embodiment.

The nozzle plate 100 includes driving elements 130, a protective film 150, which is a protective layer, and a liquid repellent film 160 on a vibration plate 120. The vibration plate 120 is formed integrally with the pressure chamber structure 200, for example. When a heat treatment is performed on a silicon wafer 201 for producing the pressure chamber structure 200 in an oxygen atmosphere, an $SiO_2$ (silicon oxide) film is formed on the front surface of the silicon wafer 201. The vibration plate 120 is, for example, an $SiO_2$ (silicon oxide) film with a thickness of 4 μm, which is formed on a front surface of the silicon wafer 201 by performing a heat treatment in an oxygen atmosphere. The vibration plate 120 may be formed by forming an $SiO_2$ (silicon oxide) film on the front surface of the silicon wafer 201 using a chemical vapor deposition method (CVD method).

It is preferable that the thickness of the vibration plate 120 is in a range of 1 μm to 50 μm. The vibration plate 120 may be formed of a semiconductor material such as SiN (silicon nitride), or an aluminum oxide ($Al_2O_3$) or the like, in place of $SiO_2$ (silicon oxide).

One of the driving elements 130 is provided for each nozzle 110. Each of the driving elements 130 has an annular shape that surrounds the corresponding nozzle 110. The shape of the driving element 130 is not limited thereto, and for example, may be a C-shape.

As shown in FIG. 7, each of the driving elements 130 includes an electrode portion 131*a* of a lower electrode 131 and an electrode portion 133*a* of an upper electrode 133, and a piezoelectric film 132, which is a piezoelectric body, disposed therebetween. The electrode portion 131*a*, the piezoelectric film 132, and the electrode portion 133*a* are coaxial with the nozzle 110, and are circular patterns of the same size.

The lower electrodes 131 include a plurality of circular electrode portions 131*a* that are coaxial with the plurality of circular nozzles 110. For example, if the diameter of the nozzles 110 is set at 20 μm, the outer diameter of the electrode portions 131*a* is set at 133 μm, and the inner diameter is set at 42 μm. As shown in FIG. 5, each of the lower electrodes 131 includes a wiring portion 131*b* that connects a plurality of electrode portions 131*a*, and a lower electrode terminal portion 131*c* at an end of the wiring portion 131*b*.

Each of the driving elements 130 includes the piezoelectric film 132, which is a piezoelectric material with a thickness of 2 μm, for example, formed on the electrode portions 131*a* of the of the lower electrode 131. The piezoelectric film 132 is formed from PZT (Pb (Zr, Ti) $O_3$: lead zirconate titanate). The piezoelectric film 132 has an annular shape that, for example, is coaxial with the corresponding nozzle 110, and has an external diameter of 133 μm that is the same as that of the electrode portions 131*a*, and an internal diameter of 42 μm. The thickness of the piezoelectric film 132 is generally in a range of 1 μm to 5 μm. For example, the piezoelectric film 132 can be formed of a piezoelectric material such as PTO ($PbTiO_3$: lead titanate), PMNT (Pb ($Mg_{1/3}$ $Nb_{2/3}$) $O_3$—$PbTiO_3$), PZNT (Pb($Zn_{1/3}$ $Nb_{2/3}$) $O_3$— $PbTiO_3$), ZnO or AlN.

The piezoelectric film 132 is polarized in the thickness direction. When an electric field is applied to the piezoelectric film 132 along the direction of the polarization, the piezoelectric film 132 expands and contracts in a direction that is orthogonal to an electric field direction. In other words, the piezoelectric film 132 contracts or extends in a direction that is orthogonal to the thickness direction.

The upper electrode 133 of the driving element 130 has an annular shape that is coaxial with the corresponding nozzle 110 on the piezoelectric film 132, and has an external diameter of 133 μm that is the same as that of the piezoelectric film 132, and an internal diameter of 42 μm. As shown in FIG. 5, the upper electrode 133 includes a wiring portion 133*b* that connects a plurality of electrode portions 133*a*, and two upper electrode terminals 133*c* at end of the wiring portion 133*b*. In a case in which the upper electrode 133 is connected to a fixed voltage, a voltage control signal is applied to the lower electrode 131.

For example, the lower electrode 131 is formed by laminating Ti (titanium) and Pt (platinum) with a thickness of 0.5 μm using a sputtering technique. The thickness of the lower electrode 131 is generally in a range of 0.01 μm to 1 μm. The lower electrode 131 may be formed of another material such as Ni (nickel), Cu (copper), Al (aluminum), Ti (titanium), W (tungsten), Mo (molybdenum), Au (gold), or $SrRuO_3$ (strontium ruthenium oxide). The lower electrode 131 may be formed of layers of various kinds of metal.

The upper electrode 133 is formed of a Pt thin film. The upper electrode 133 is set to have a thickness of 0.5 μm and formed using a sputtering technique. It is possible to use Ni, Cu, Al, Ti, W, Mo, Au, $SrRuO_3$, or the like as another electrode material of the upper electrode 133. It is possible to use vapor deposition or plating as another film formation technique. The upper electrode 133 may be formed of layers of various kinds of metal. A preferable thickness of the upper electrode 133 is from 0.01 μm to 1 μm.

The nozzle plate 100 includes an insulation film 140 that electrically insulates the lower electrode 131 and the upper electrode 133. For example, the insulation film 140 is formed of $SiO_2$ (silicon oxide) and has a thickness of 0.5 μm. The insulation film 140 covers a periphery of the electrode portion 131*a*, the piezoelectric film 132, and the electrode portion 133*a*, that is, around the driving element 130. Specifically, the insulation film 140 covers the wiring portion 131*b* of the lower electrode 131. The insulation film 140 also covers the vibration plate 120 in a region thereof on which the wiring portion 133*b* of the upper electrode 133 is formed. The insulation film 140 includes a contact region (opening) 140*a* through which the electrode portion 133*a* and the wiring portion 133*b* of the upper electrode 133 are electrically connected.

The nozzle plate 100 includes, for example, a protective film 150 that is formed of polyimide and protects the driving element 130. The protective film 150 includes a cylindrical solution passage region (opening) 141 that is in communication with the nozzle 110 of the vibration plate 120. The solution passage region 141 has a diameter of 20 μm, or the same as the diameter of the nozzle 110 of the vibration plate 120.

The protective film 150 may be formed of another insulating material such as other resins or ceramics. Acrylonitrile butadiene styrene (ABS), polyacetal, polyamide, polycarbonate, oil ether sulfone, and the like are examples of other resins. For example, zirconia, silicon carbide, silicon nitride, and the like are examples of ceramics. The thickness of the protective film 150 is generally in a range of 2 μm to 50 μm.

In material selection of the protective film 150, Young's modulus, thermal resistance, insulating properties (the effect on high-conductive solution by contacting the upper electrode 133), thermal expansion coefficient, smoothness, and wettability with respect to the solution are taken into consideration.

The nozzle plate 100 also includes a liquid repellent film 160 that covers the protective film 150. The liquid repellent film 160 is formed by performing spin coating of a silicone-based resin, for example, that has a property of repelling the solution. The liquid repellent film 160 can be formed with a solution-repelling material such as a fluorine-containing resin. The thickness of the liquid repellent film 160 is 0.5 μm, for example.

The pressure chamber structure 200 is formed of a silicon wafer 201 with a thickness of 525 μm, for example. The pressure chamber structure 200 includes a warp reduction film 220 on a surface of the silicon wafer 201 that faces the vibration plate 120. The pressure chamber structure 200 defines side surfaces of the pressure chambers 210, each of which penetrates the pressure chamber structure and is in communication with a corresponding nozzle 110 of the vibration plate 120. Each of the pressure chambers 210 is formed in a circular shape with a diameter 190 μm, for example, and positioned on the same axis as the corresponding nozzle 110. The shape and size of the pressure chambers 210 is not limited thereto.

In the first embodiment, the pressure chambers 210 are in communication with a corresponding opening 22*a* of the solution container 22. It is preferable that a size L of the pressure chambers 210 in the depth direction is larger than a size D thereof in the width direction. By setting the size D in the width direction to be smaller than the size L in the depth direction, pressure applied to the solution in the pressure chambers 210 is less likely to escape to the solution containers 22 due to vibration of the vibration plate 120 of the nozzle plate 100.

The bottom of each pressure chamber 210 on which the vibration plate 120 is disposed is referred to as a first surface, and the top of each pressure chamber 210 on which the warp reduction film 220 is disposed is referred to as a second surface. The solution containers 22 are adhered to the warp reduction film 220 using an epoxy-based adhesive agent, for example. The pressure chambers 210 are in communication with the openings 22*a* of the solution containers 22 on the side of the warp reduction film 220. Opening areas of the openings 22*a* of the solution containers 22 are greater than opening areas of the openings of the pressure chambers 210 that are in communication with the openings 22*a* of the solution containers 22.

For example, the warp reduction film 220 is an $SiO_2$ (silicon oxide) film with a thickness of 4 μm and formed on a surface of the silicon wafer 201 by performing a heat treatment on the silicon wafer 201 for producing the pressure chamber structure 200 in an oxygen atmosphere. The warp reduction film 220 may be formed of an $SiO_2$ (silicon oxide) film on the surface of the silicon wafer 201 using a chemical vapor deposition method (CVD method). The warp reduction film 220 reduces warp generated in the liquid droplet ejection array 27.

The warp reduction film 220 is formed on a surface of the silicon wafer 201 that faces the solution containers 22 to reduce warp of the silicon wafer 201. The warp reduction film 220 reduces warp of the silicon wafer 201 that is caused as a result of differences in the film stress of the pressure chamber structure 200 and the vibration plate 120, differences in the film stress of various constituent films of the driving elements 130, and the like. In a case in which the members of the liquid droplet ejection array 27 are formed using a film formation process, the warp reduction film 220 reduces warp of the liquid droplet ejection array 27.

The material and the thickness of the warp reduction film 220 may be different from those of the vibration plate 120. However, if the warp reduction film 220 is set to have the same thickness as the vibration plate 120 using the same material, a film stress on the vibration plate 120 and a film stress on the warp reduction film 220 become the same at both surfaces of the silicon wafer 201. If the warp reduction film 220 is set to have the same thickness as the vibration plate 120 using the same material, warp generated in the liquid droplet ejection array 27 can be more effectively reduced.

The vibration plate 120 deforms in a thickness direction as a result of the action of the planar driving elements 130. The liquid droplet ejecting apparatus discharges a solution that is supplied to the nozzles 110 as a result of pressure change that is generated inside the pressure chambers 210 due to deformation of the vibration plate 120.

An example of a method for manufacturing the liquid droplet ejection array 27 will be described. First, an $SiO_2$ (silicon oxide) film is formed on the entirety of both surfaces of the silicon wafer 201 for forming the pressure chamber structure 200. An $SiO_2$ (silicon oxide) film that is formed on one surface of the silicon wafer 201 is used as the vibration plate 120. An $SiO_2$ (silicon oxide) film that is formed on the other surface of the silicon wafer 201 is used as the warp reduction film 220.

For example, an $SiO_2$ (silicon oxide) film is formed on both surfaces of the disk-shaped silicon wafer 201 using a thermal oxidation technique of performing a heat treatment in an oxygen atmosphere using a batch-type reacting furnace, for example. Next, a plurality of nozzle plates 100 and pressure chambers 210 are formed on the disk-shaped silicon wafer 201 through a film formation process. After the nozzle plates 100 and the pressure chambers 210 are formed, the disk-shaped silicon wafer 201 is cut into a plurality of pressure chamber structural members 200 on which the nozzle plates 100 are attached. It is possible to mass produce a plurality of liquid droplet ejection arrays 27 using the disk-shaped silicon wafer 201. The silicon wafer 201 may have a shape other than the disk-shape. The structure of the nozzle plate 100 and the pressure chamber structure 200 may be formed individually using a single rectangular silicon wafer 201.

The nozzles 110 are formed by patterning the vibration plate 120 that is formed on the silicon wafer 201 using an etching mask. The patterning uses a photosensitive resist as the material of the etching mask. An etching mask, in which openings that correspond to the nozzles 110 are patterned, is formed by exposing and developing after coating the front surface of the vibration plate 120 with the photosensitive resist. The nozzles 110 are formed by performing dry etching of the vibration plate 120 so that the etching reaches the pressure chamber structure 200. After forming the nozzles 110 on the vibration plate 120, the etching mask is removed using a stripping solution, for example.

Next, the driving elements 130, the insulation film 140, the protective film 150, and the liquid repellent film 160 are formed on the front surface of the vibration plate 120, in which the nozzles 110 are formed. In order to form the driving elements 130, the insulation film 140, the protective film 150, and the liquid repellent film 160, a film formation step and a patterning step are repeated. The film formation step is performed using a sputtering technique, a CVD technique, a spin coating technique, or the like. The patterning is performed by forming an etching mask on a film using a photosensitive resist, for example, and removing the etching mask after performing etching of the film material using the etching mask.

The materials of the lower electrode 131, the piezoelectric film 132, and the upper electrode 133 are laminated on the vibration plate 120. As the lower electrode 131, a Ti (titanium) film with a thickness of 0.05 μm and a Pt (platinum) film with a thickness of 0.45 μm are sequentially formed using a sputtering technique. The Ti (titanium) and Pt (platinum) films may be formed using a vapor deposition technique or plating.

To form the piezoelectric film 132, a PZT (Pb (Zr, Ti) $O_3$: lead zirconate titanate) film with a thickness of 2 μm is formed on the lower electrode 131 using an RF magnetron sputtering technique at a substrate temperature of 350° C. After the formation of the PZT film, a heat treatment at 500° C. for 3 hours is performed on the PZT film to obtain favorable piezoelectric property. The PZT film may be formed using CVD (chemical vapor deposition technique), a sol-gel technique, an AD (aerosol deposition) technique, or a hydrothermal synthesis technique.

To form the upper electrode 133, a Pt (platinum) film with a thickness of 0.5 μm is formed on the piezoelectric film 132 using a sputtering technique. An etching mask to form the electrode portion 133*a* of the upper electrode 133 and the piezoelectric film 132 without etching the lower electrode 131 is formed on the Pt (platinum) film. The electrode portion 133*a* of the upper electrode 133 and the piezoelectric film 132 are formed by patterning the films of Pt (platinum) and PZT (Pb (Zr, Ti) $O_3$: lead zirconate titanate) using the etching mask.

Next, an etching mask to form the lower electrode terminal 131*c* of the lower electrode 131 without etching the electrode portion 131*a* and the wiring portion 131*b*, is formed on the film of the lower electrode 131 on which the electrode portion 133*a* of the upper electrode 133 and the piezoelectric film 132 are formed. The lower electrode 131 is formed by patterning the Ti (titanium) and the Pt (platinum) films using the etching mask.

To form the insulation film 140, an $SiO_2$ (silicon oxide) film with a thickness of 0.5 μm is formed on the vibration plate 120 on which the lower electrode 131, the electrode portion 133*a* of the upper electrode 133, and the piezoelectric film 132 are formed.

A low-temperature film formation, for example, CVD, is carried out to obtain favorable insulating properties in the $SiO_2$ (silicon oxide) film. The insulation film 140 is formed by patterning the $SiO_2$ (silicon oxide) film.

To form the wiring portion 133*b* and the upper electrode terminal 133*c* of the upper electrode 133, Au (gold) with a thickness of 0.5 μm is formed on the vibration plate 120 on which the insulation film 140 is formed using a sputtering technique. The Au (gold) film may be formed using a vapor deposition technique, a CVD technique, or plating. An etching mask to pattern the Au (gold) film without etching the wiring portion 133*b* and the upper electrode terminal 133*c* of the upper electrode 133 is formed on the Au (gold)

film. The wiring portion 133*b* and the upper electrode terminal 133*c* of the upper electrode 133 are formed by patterning the Au (gold) film using the etching mask.

A polyimide film, which is the material of the protective film 150, with a thickness of 4 μm is formed on the vibration plate 120 on which the upper electrode 133 was formed. The polyimide film is formed by coating the vibration plate 120 with a solution that includes a polyimide precursor using a spin coating technique, and removing thermal polymerization products and solvents through baking. The protective film 150, which exposes the solution passage region 141, the lower electrode terminal 131*c* of the lower electrode 131 and the upper electrode terminal 133*c* of the upper electrode 133, is formed by patterning the polyimide film.

The protective film 150 is coated with a silicone-based resin film, which is the material of the liquid repellent film 160, to a thickness of 0.5 μm using a spin coating technique, and thermal polymerization products and solvents are removed through baking. The liquid repellent film 160, which exposes the nozzles 110, the solution passage region 141, the lower electrode terminal 131*c* of the lower electrode 131 and the upper electrode terminal 133*c* of the upper electrode 133, is formed by patterning the silicone-based resin film.

The liquid repellent film 160 is protected by, for example, putting a protective tape to protect a rear surface of the silicon wafer 201 from the CMP (the chemical mechanical polishing) onto the liquid repellent film 160 as a covering tape, and patterning of the pressure chamber structure 200 is performed. An etching mask is formed on the warp reduction film 220 of the silicon wafer 201 so as to expose regions of the pressure chambers 210*a* having diameter of 190 μm, and dry etching of the warp reduction film 220 is performed using a mixed gas of $CF_4$ (4 carbon fluoride) and $O_2$ (oxygen). Next, vertical deep dry etching is performed exclusively on the silicon wafer 201 using a mixed gas of $SF_6$ (6 sulfur fluoride) and $O_2$, for example. The dry etching is stopped at a position of the vibration plate 120 to form the pressure chambers 210 in the pressure chamber structure 200.

The etching to form the pressure chambers 210 may be performed using a wet etching technique that uses a liquid chemical, a dry etching technique using plasma, or the like. After the etching is finished, the etching mask is removed. A plurality of liquid droplet ejection arrays 27 are separated and formed by weakening the adhesiveness of covering tape, which is pasted onto the liquid repellent film 160, through the irradiation of ultraviolet rays, and subsequently peeling the covering tape away from the liquid repellent film 160, and cutting the disk-shaped silicon wafer 201.

Next, a method for manufacturing the liquid droplet ejecting apparatus 2 will be described. The liquid droplet ejection arrays 27 and the solution containers 22 are adhered to one another. At this time, a bottom surface of the solution container 22 having the opening 22*a* is adhered to the warp reduction film 220 on the pressure chamber structure 200.

Thereafter, the solution containers 22 fixed to the liquid droplet ejection arrays 27 is fixed to the recess portions 21*a* of the base member 21. Next, the electric substrates 23 are fixed to the recess portions 21*b* that are formed on the rear side of the base member 21. At this time, the electric substrates 23 are fixed to the recess portions 21*b* of the base member 21 in a state in which the electric substrate wiring 24 is located on a lower side (a side opposite to a side at which the nozzle plate 100 contacts the pressure chambers 210) in FIG. 4 and FIG. 6.

Next, the electrode terminal connection portion 26 of the electric substrate wiring 24, and the lower electrode terminal 131*c* of the lower electrode 131, and two upper electrode terminals 133*c* of the upper electrode 133 of the liquid droplet ejection array 27 are connected using the wiring 12. A method that uses a flexible cable, or the like, is an example of another connection method. This is a method that electrically connects an electrode pad of a flexible cable and the electrode terminal connection portion 26, or the terminal portion 131*c* and terminal portions 133*c* using an anisotropic conductive film by thermocompression.

Another terminal of the electric substrate wiring 24 is the input terminal 25, and for example, has a shape that can contact a plate spring connector to input a control signal, which is output from a control circuit, which is not illustrated in the drawings. As a result, the liquid droplet ejecting apparatus 2 is formed.

Next, operations of the liquid droplet ejection apparatus 2 of the above-described configuration will be described. The liquid droplet ejecting apparatus 2 according to the present embodiment is used by being fixed to the liquid droplet ejecting apparatus mounting module 5 of the solution dripping apparatus 1. During use of the liquid droplet ejecting apparatus 2, first, a predetermined amount of a solution is supplied to the solution container 22 from the upper surface openings 22*b* of the solution container 22 using a pipette, or the like, which is not illustrated in the drawings. The solution is retained in the solution container 22. The opening 22*a* of the solution container 22 is in communication with the liquid droplet ejection array 27. Each pressure chamber 210 of the liquid droplet ejection array 27 is filled with the solution that has been filled in the solution container 22 via the opening 22*a* of the solution container 22.

In this state, the voltage control signal that is input to the control signal input terminal 25 of the wiring 24 is sent to the lower electrode terminal portion 131*c* of the lower electrode 131 and the upper electrode terminal 133*c* of the upper electrode 133 from the electrode terminal connection portion 26 of the electric substrate wiring 24. At this time, the solution is discharged as droplets from the nozzles 110 of the liquid droplet ejection array 27 by changing the cubic capacity of the pressure chambers 210 as a result of deformation of the vibration plate 120 by the application of a voltage control signal to the driving element 130. Further, a predetermined amount of liquid is dripped into each well 4*b* of the microplate 4 from the nozzles 110.

The amount of a single drop of the liquid that is discharged from the nozzles 110 is from 2 picoliters to 5 picoliters. Therefore, it is possible to drip amounts of a liquid of an order of picoliters to microliters into each well 4*b* by controlling the number of times of the dripping.

According to the liquid droplet ejecting apparatus 2 of the first embodiment, each piece of wiring (the wiring portion 131*b* and the lower electrode terminal 131*c* of the lower electrode 131, the wiring portion 133*b* and the upper electrode terminal 133*c* of the upper electrode 133, the wiring 12 and the electric substrate wiring 24 of the electric substrate 23) that is connected to the driving elements 130 of the liquid droplet ejection arrays 27, is disposed on a surface (a lower surface) of the liquid droplet ejection array 27 that is opposite to a surface at which the nozzle plate 100 contacts the pressure chambers 210. Also, the electric substrate wiring 24 is formed on a lower surface of the electric substrate 23. For that reason, even if the solution spills over from the solution containers 22 when the solution is supplied into the solution containers 22 from the upper surface openings 22*b* of the solution containers 22 using a pipette, or the like, the solution that has spilt over is less likely to be adhered to the above-described wiring on the lower surface of the liquid droplet ejection array 27. Therefore, the solution is less likely to be adhered to the electric substrate wiring 24 of the electric substrate 23 as a result of the solution overflowing from the solution containers 22 by excessively supplying the solution thereto, the solution splashing back up from the solution containers 22 due to excessively high pressure of the solution, or the like. As a result, it is possible to provide a liquid droplet ejecting apparatus 2 that can prevent corrosion of the electric substrate wiring 24, and an electrical short caused by the solution being adhered to adjacent electric substrate wiring 24 or the like.

As shown in FIGS. 4 and 6, the inner surface of the solution container 22, the inner surface of the pressure chamber 210 and the inner surface of the nozzle 110, which contact the solution, are exposed to the outside. That is, the entirety of the liquid flow channel that causes the liquid to be discharged from the nozzle 110 through the inside of the pressure chamber 210 from the solution container 22 can be irradiated with light. Therefore, it is possible to perform ultraviolet ray irradiation cleaning of the inner surface of the solution container 22, the inner surface of the pressure chamber 210, and the inner surface of the nozzle 110, which contact the solution, by irradiating the bottom portion of the solution container 22 with ultraviolet rays directed from the upper surface openings 22*b*. According to the ultraviolet ray irradiation cleaning, it is possible to volatilize and remove organic matter that is adhered to the inner surface of the solution container 22 by chemically changing the organic matter into volatile substances such as carbon dioxide as a result of irradiating the inner surface of the solution container 22 with ultraviolet rays.

Accordingly, in comparison with a case of performing the three steps of filling a cleaning solution, removing the cleaning solution using purified water, or the like, and drying the solution container 22, time to clean the solution container 22 by the ultraviolet ray irradiation cleaning is shorter.

According to the liquid droplet ejecting apparatus 2 of the first embodiment that has the above-described configuration, it is possible to prevent the wiring 24 from being corroded, an electrical short caused by the solution being adhered to adjacent wiring 24 or the like, without solution that has spilt over from the solution containers 22 being adhered to the wiring 24, which is connected to the driving element 130.

Second Embodiment

Figure 8:
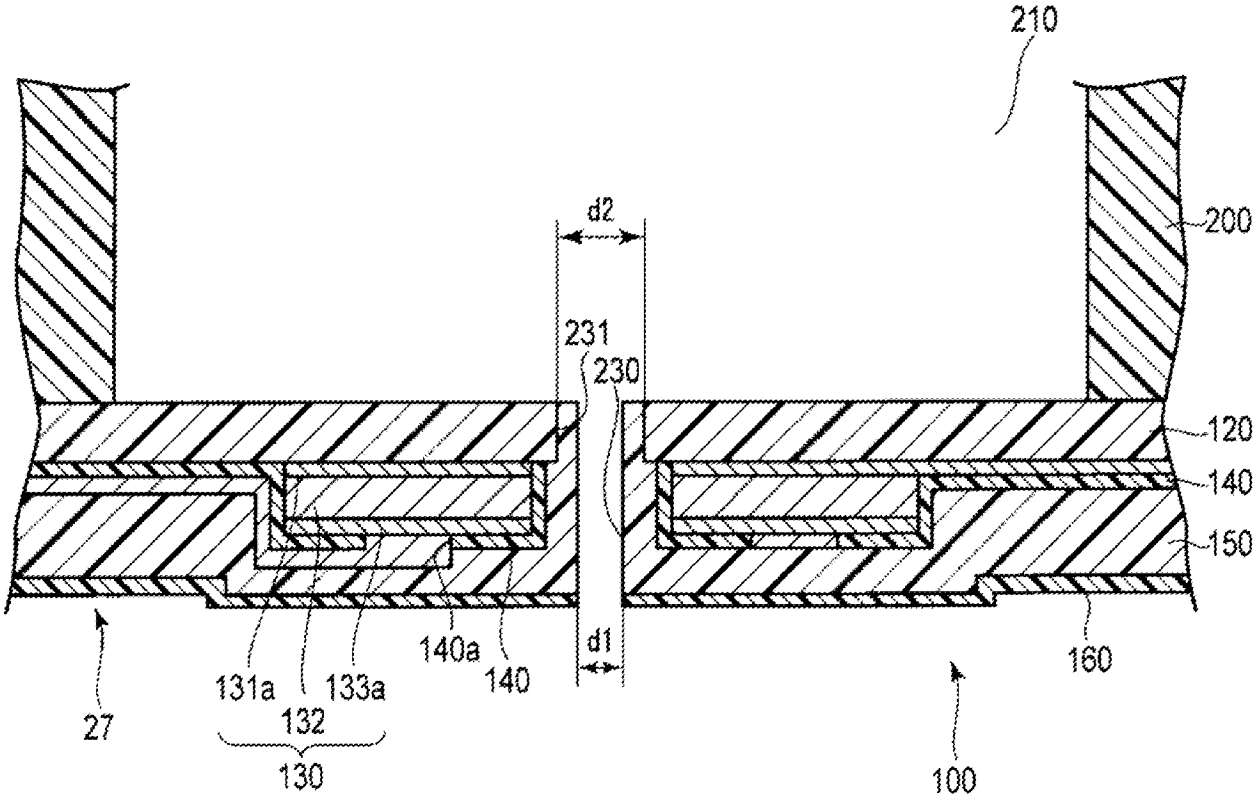
FIG. 8 is a cross-sectional view of a nozzle of a liquid droplet ejecting apparatus according to a second embodiment.

FIG. 8 shows a liquid droplet ejection array 27 according to a second embodiment. The present embodiment is a modification example in which the configuration of the liquid droplet ejecting apparatus 2 according to the first embodiment (refer to FIGS. 1 to 7) is changed in the following manner. In the first embodiment, the solution passage regions 141, which are in communication with the nozzles 110 of the vibration plate 120, are formed on the protective film 150 of the nozzle plate 100. Instead, in the second embodiment, nozzles 230 having a diameter d1 are formed through the protective film 150. In the second embodiment, the same portions as those of the above-mentioned first embodiment will be described with the same reference numerals, and detailed description thereof will be omitted.

As shown in FIG. 8, the vibration plate 120 of the nozzle plate 100 of the liquid droplet ejecting apparatus 2 has a peripheral hole 231 having a diameter d2, which is an opening that is in a coaxial position with the nozzle 230 having the diameter d1. The diameter d2 of the peripheral hole 231 is larger than the diameter d1 of the nozzle 230. The diameter d1 of the nozzle 230 is, for example 20 μm. As a result, a peripheral wall portion of the nozzle 230 of the protective film 150 covers the inner peripheral surface of the peripheral hole 231 of the vibration plate 120, and is in communication with the pressure chamber 210.

During manufacture of the liquid droplet ejecting apparatus 2, the peripheral hole 231 is formed by patterning the vibration plate 120, which is integral with the silicon wafer 201 for the pressure chamber structure 200 using an etching mask. A polyimide film, which is the protective film 150, is formed on the vibration plate 120 above which the driving element 130 is formed. The protective film 150, which has the nozzle 230, is formed by patterning the polyimide film. The protective film 150 exposes the lower electrode terminal 131*c* of the lower electrode 131 and the upper electrode terminal 133*c* of the upper electrode 133.

For example, since the nozzle 110 and the solution passage region 141, which have the same axis and the same diameter, are respectively patterned as in the first embodiment, the shapes of the nozzle 110 of the vibration plate 120 and the solution passage region 141 of the protective film 150 may become non-uniform. Further, when the nozzle 110 and the solution passage region 141 are non-uniform, dripping positions of droplets of the solution that are discharged from the nozzles 110 may be shifted.

In contrast, the nozzles 230 according to the second embodiment are formed by a single patterning process that is carried out on the protective film 150. As a single patterning process enables the inner peripheral surfaces of the nozzle 230 to be formed more uniformly, the dripping position of droplets of solution discharged from the nozzle 230 are less likely to be shifted. As a result, it is possible to obtain high dripping position accuracy during solution dripping using the liquid droplet ejecting apparatus 2.

According to the liquid droplet ejecting apparatus of the second embodiment, in the same manner as the first embodiment, each piece of wiring (the wiring portion 131*b* and the lower electrode terminal portion 131*c* of the lower electrode 131, the wiring portion 133*b* and the upper electrode terminals portions 133*c* of the upper electrode 133, the wire wiring 12, and the electric substrate wiring 24 of the electric substrate 23) that is connected to the driving elements 130 of the liquid droplet ejection arrays 27, is disposed on a surface (a lower surface) of the liquid droplet ejection array 27 that is opposite to a surface at which the liquid droplet ejection array 27 contacts the solution container 22. Also, the electric substrate wiring 24 is formed on a lower surface of the electric substrate 23. Since the solution is less likely to be adhered to the electric substrate wiring 24 of the electric substrate 23 even if the solution spills over from the solution containers 22, it is possible to provide a liquid droplet ejecting apparatus that prevents corrosion of the electric substrate wiring 24 and an electrical short that are caused by the solution being adhered to the electric substrate wiring 24 or the like.

Furthermore, in the liquid droplet ejecting apparatus 2 according to the present embodiment, the nozzles 230 are formed on the protective film 150, which covers the inner peripheral surface of the peripheral holes 231 of the vibration plate 120 using a single patterning process. As a result, it is possible to make the inner peripheral surface of the nozzles 230, which is in communication with the pressure chambers 210, uniform, and therefore, it is possible to maintain the dripping position accuracy of droplets of solution that are discharged from the nozzles 230.

Third Embodiment

Figure 9:
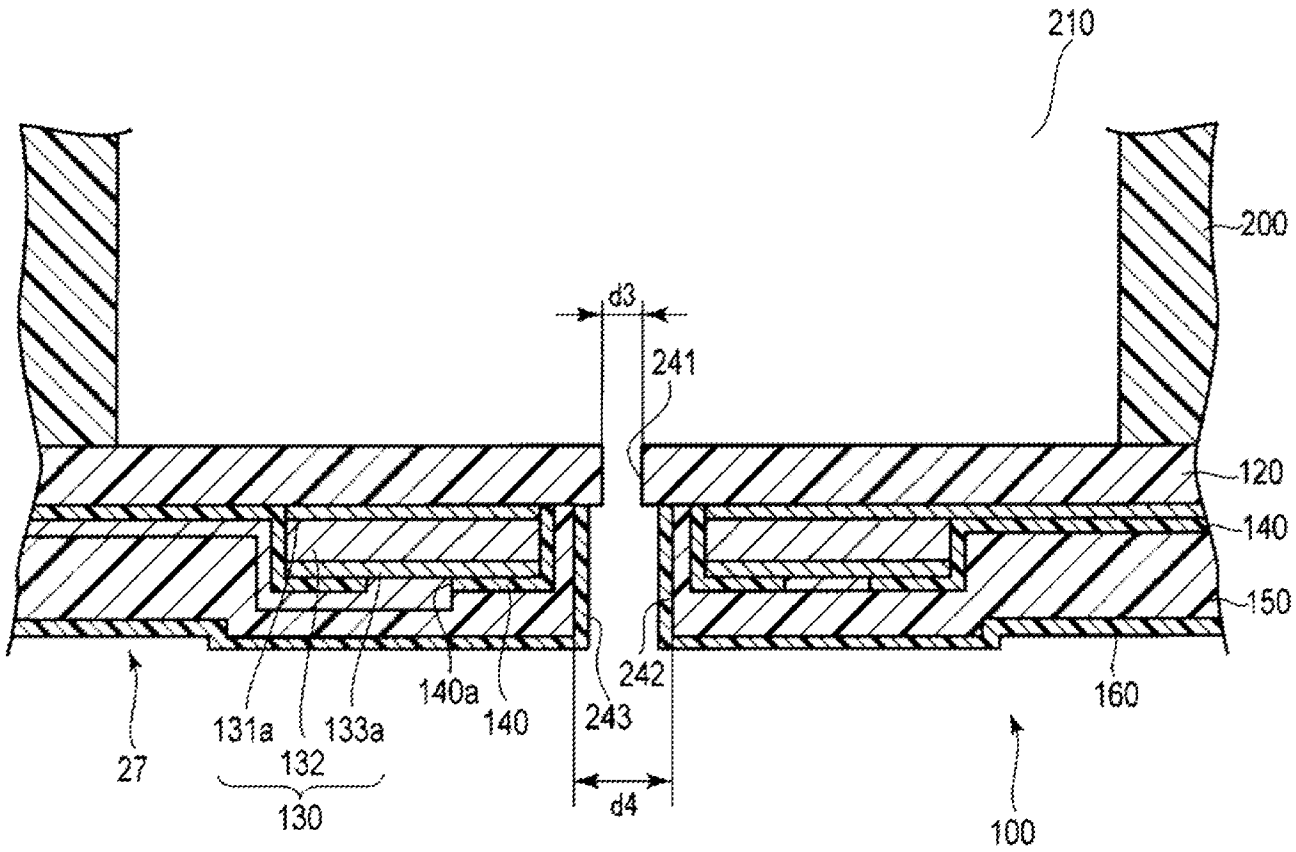
FIG. 9 is a cross-sectional view of a nozzle of a liquid droplet ejecting apparatus according to a third embodiment.

FIG. 9 shows a liquid droplet ejection array 27 according to a third embodiment. The present embodiment is another modification example of the liquid droplet ejecting apparatus 2 of the first embodiment (refer to FIGS. 1 to 7). In the third embodiment, the same portions as those of the above-mentioned first embodiment will be described with the same reference numerals, and detailed description thereof will be omitted.

In the present embodiment, nozzles 241 having a diameter d3 are formed on the vibration plate 120 of the nozzle plate 100 of the liquid droplet ejecting apparatus 2. Solution passage regions 242, each of which is coaxial with the corresponding nozzle 241 of the vibration plate 120, have a diameter d4 that is greater than the diameter d3 of the nozzles 241, and are formed on the protective film 150. For example, the diameter d3 of the nozzles 241 is set at 20 μm, and the diameter d4 of the solution passage regions 242 is set at 30 μm.

The nozzle plate 100 includes a liquid repellent film 160 on the protective film 150. The liquid repellent film 160 includes a covering portion 243 that covers the front surface of the solution passage regions 242 of the protective film 150. As a result, the solution passage region 242 is in communication with the nozzle 241 via the covering portion 243 of the liquid repellent film 160.

During manufacture of the liquid droplet ejecting apparatus 2, the protective film 150, which is a polyimide film, is formed above the driving element 130 of the vibration plate 120, which has the nozzle 241. At this time, the protective film 150, which has the solution passage regions 242, is formed by patterning the polyimide film. The protective film 150 exposes the lower electrode terminal 131*c* of the lower electrode 131 and the upper electrode terminal 133*c* of the upper electrode 133.

Next, a silicone-based resin film, which is the material of the liquid repellent film 160, is formed on the protective film 150. The liquid repellent film 160 is formed by patterning the silicone-based resin film. The liquid repellent film 160 covers the front surface of the protective film 150 without being adhered to the inner peripheral surfaces of the nozzles 241. The lower electrode terminal 131*c* of the lower electrode 131 and the upper electrode terminal 133*c* of the upper electrode 133 are exposed.

In the first embodiment, when the patterning of the nozzle 110 and the solution passage region 141, which are coaxial and have the same diameter, is non-uniform, the dripping positions of droplets of solution that are discharged from the nozzles 110 may be shifted. In contrast, according to the third embodiment, the diameter d4 of the solution passage regions 242 of the protective film 150 is larger than the diameter d3 of the nozzles 241 of the vibration plate 120. Therefore, even when the central position of the patterning of the nozzle 241 of the vibration plate 120 and the solution passage region 242 of the protective film 150 is shifted to a certain extent, the dripping positions are less likely to be shifted.

According to the liquid droplet ejecting apparatus 2 of the third embodiment, in the same manner as the first embodiment, each piece of wiring (the wiring portion 131*b* and the lower electrode terminal 131*c* of the lower electrode 131, the wiring portion 133*b* and the upper electrode terminal 133*c* of the upper electrode 133, the wiring 12 and the electric substrate wiring 24 of the electric substrate 23) that is connected to the driving elements 130 of the liquid droplet ejection arrays 27, is disposed on a surface (a lower surface) of the liquid droplet ejection array 27 that is opposite to a surface at which the liquid droplet ejection array 27 contacts the solution container 22. Also, the electric substrate wiring 24 is formed on a lower surface of the electric substrate 23. As a result, the solution is less likely to be adhered to the electric substrate wiring 24 of the electric substrate 23 even if the solution spills over from the solution containers 22. Accordingly, it is possible to provide a liquid droplet ejecting apparatus that prevents corrosion of the electric substrate wiring 24 of the electric substrate 23 and an electrical short that are caused by the solution being adhered to the electric substrate wiring 24 of the electric substrate 23 or the like.

Furthermore, in the liquid droplet ejecting apparatus 2 of the third embodiment, the diameter d4 of the solution passage regions 242 formed on the protective film 150 is larger than the diameter d3 of the nozzles 241 of the vibration plate 120. Even if the central positions of the patterning of the nozzles 241 and the solution passage region 242 are shifted, droplets of solution discharged from the nozzles 241 are not subjected to the effects of the solution passage regions 242. Accordingly, it is possible to maintain favorable dripping position accuracy of the droplets of the solution from the nozzles 241.

Fourth Embodiment

Figure 10:
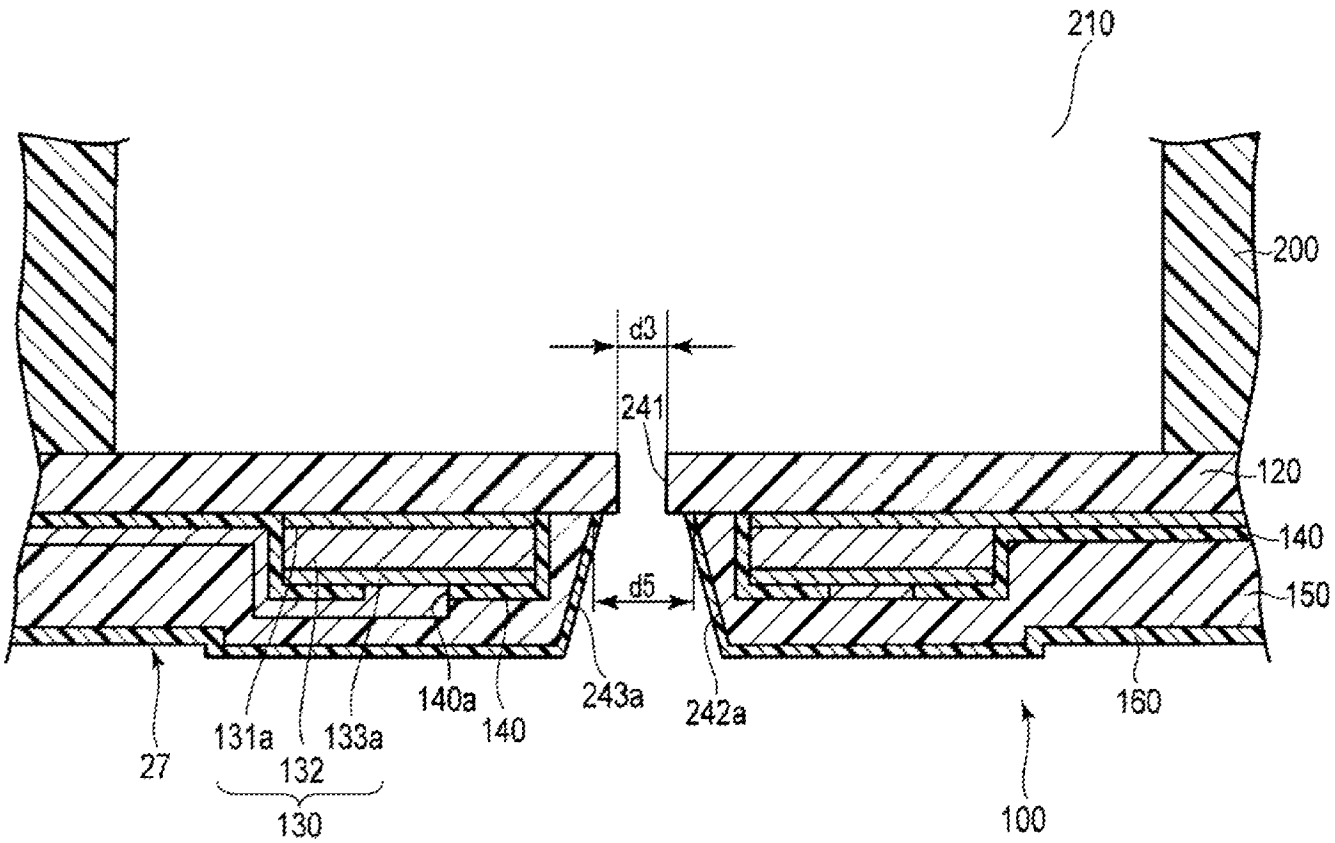
FIG. 10 is a cross-sectional view of a nozzle of a liquid droplet ejecting apparatus according to a fourth embodiment.

FIG. 10 shows a liquid droplet ejection array 27 according to a fourth embodiment. The present embodiment is a modification example of the liquid droplet ejecting apparatus 2 of the third embodiment (refer to FIG. 9). In the fourth embodiment, the same portions as those of the third embodiment will be described with the same reference numerals, and detailed description thereof will be omitted.

In the third embodiment, the solution passage regions 242 formed on the protective film 150 have a cylindrical configuration, that is, have a uniform diameter d4 of the inner peripheral surface. Instead, in the liquid droplet ejecting apparatus 2 of the fourth embodiment, a tapered surface 242*a*, such that the diameter becomes greater toward an outer side (an ejecting direction of liquid droplet), is formed on the inner peripheral surface of the solution passage regions 242, which is formed on the protective film 150.

As shown in FIG. 10, the nozzle plate 100 of the liquid droplet ejecting apparatus 2 includes each nozzle 241 having the diameter d3 and the corresponding driving element 130 on the vibration plate 120, and further includes the protective film 150 and the liquid repellent film 160. The material of the protective film 150 is a negative photosensitive polyimide. The protective film 150 has the solution passage regions 242*a*, each of which is coaxial with the corresponding nozzle 241, an opening that has a diameter d5 on a surface facing the vibration plate 120, which is greater than the diameter d3 of the corresponding nozzle 241. The cross-sectional shape of the solution passage regions 242*a* is a trapezoidal shape.

For example, the diameter d3 of the nozzles 241 is set at 20 μm, and the diameter d5 of the opening of the solution passage regions 242*a* is set at 30 μm. The solution passage regions 242*a* are formed in a trapezoidal shape such that the width thereof becomes wider toward a liquid repellent film 160. The liquid repellent film 160 includes covering portions 243*a* that cover the tapered surfaces 242*a* of the protective film 150, and in communication with the nozzles 241. The solution passage regions 242*a* are in communication with the nozzles 241 via the covering portions 243*a* of the liquid repellent film 160.

During manufacture of the liquid droplet ejecting apparatus 2, the negative photosensitive polyimide film is formed to a thickness of 4 μm, for example, above the driving elements 130 of the vibration plate 120 which has the nozzles 241. The protective film 150, which includes the solution passage regions 242*a*, is formed by patterning the negative photosensitive polyimide film. The protective film 150 exposes the lower electrode terminal 131*c* of the lower electrode 131 and the upper electrode terminal 133*c* of the upper electrode 133.

A silicone-based resin film, which is the material of the liquid repellent film 160, is formed on the protective film 150. The liquid repellent film 160 is formed by patterning the silicone-based resin film. The liquid repellent film 160 covers the front surface of the protective film 150 without being adhered to the inner peripheral surface of the nozzle 241. The lower electrode terminal 131*c* of the lower electrode 131 and the upper electrode terminals 133*c* of the upper electrode 133 are exposed.

Generally, during patterning of the negative photosensitive polyimide film, the etching mask is irradiated with exposure light as vertically as possible. However, after passing through the etching mask, the exposure light becomes wider in a planar direction inside the negative photosensitive polyimide film. When the exposure light becomes wider in a planar direction inside the negative photosensitive polyimide film and the thickness of the negative photosensitive polyimide film is thick, an etching surface may become inclined.

The cross-sectional shape of the solution passage regions 242*a* is a trapezoidal shape so that the cross-section thereof becomes wider toward the liquid repellent film 160, and the diameter d5 of the solution passage regions 242*a* on the side of the vibration plate 120 is set to be larger than the diameter d3 of the nozzles 241. Even when the etching surface is inclined during patterning of the solution passage regions 242*a*, the dripping positions of droplets of solution discharged from the nozzles 241 are less likely to be shifted by being obstructed at the solution passage regions 242*a*, because the openings of the solution passage regions 242*a* are made wider.

According to the liquid droplet ejecting apparatus 2 of the fourth embodiment, in the same manner as the third embodiment, each piece of wiring (the wiring portion 131*b* and the lower electrode terminal 131*c* of the lower electrode 131, the wiring portion 133*b* and the upper electrode terminal 133*c* of the upper electrode 133, the wiring 12 and the electric substrate wiring 24 of the electric substrate 23) that is connected to the driving elements 130 of the liquid droplet ejection arrays 27, is disposed on a surface (a lower surface) of the liquid droplet ejection array 27 that is opposite to a surface at which the liquid droplet ejection array 27 contacts the solution container 22. Also, the electric substrate wiring 24 is formed on a lower surface of the electric substrate 23. Since the solution is less likely to be adhered to the electric substrate wiring 24 of the electric substrate 23 even if the solution spills over from the solution retention containers 22, it is possible to provide a liquid droplet ejecting apparatus that can prevent corrosion of the electric substrate wiring 24 of the electric substrate 23 and an electrical short that are caused by the solution being adhered to the electric substrate wiring 24 of the electric substrate 23 or the like.

Furthermore, in the liquid droplet ejecting apparatus 2 according to the fourth embodiment, the solution passage regions 242*a*, which is formed on the protective film 150, is formed in a trapezoidal shape so that the width thereof becomes wider towards the liquid repellent film 160. The diameter d5 of the solution passage regions 242*a* on the side of the vibration plate 120 is formed to be larger than he diameter d3 of the nozzles 241. During patterning, even when the central positions of the nozzles 241 and the solution passage regions 242*a* are shifted, droplets of solution discharged from the nozzles 241 are not obstructed at the solution passage regions 242*a*. As a result, it is possible to maintain favorable dripping position accuracy of the droplets of the solution from the nozzles 241.

Fifth Embodiment

Figure 11:
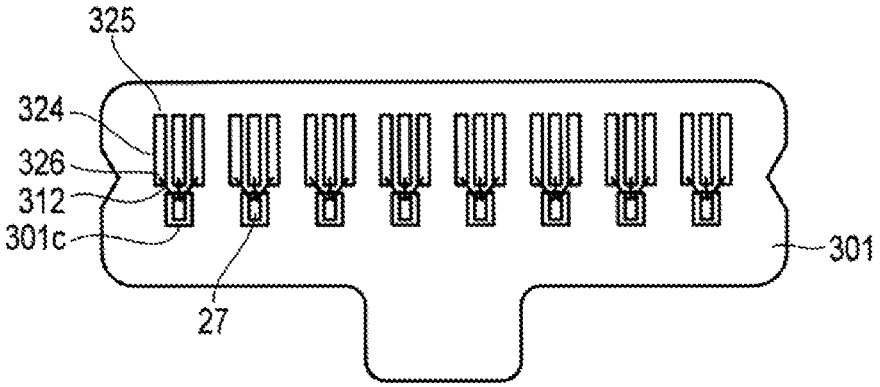
FIG. 11 is a plan view of a lower surface of a liquid droplet ejecting apparatus according to a fifth embodiment.
Figure 12:
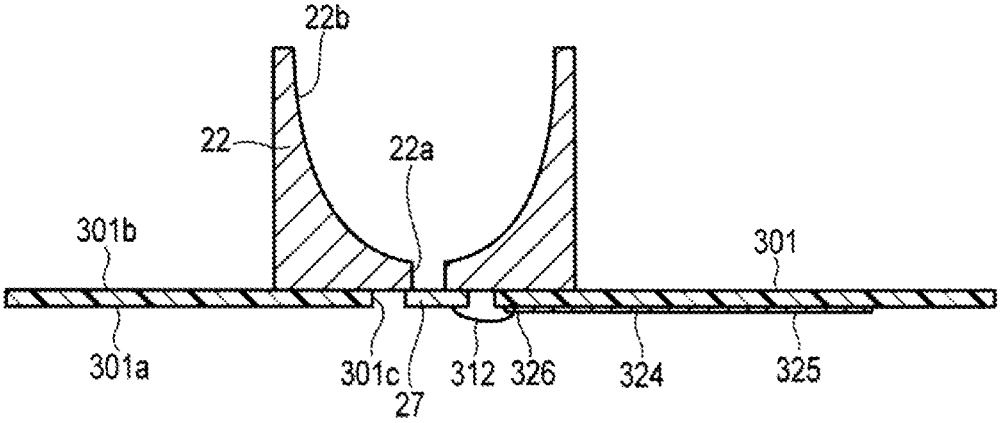
FIG. 12 is a cross-sectional view of the liquid droplet ejecting apparatus according to the fifth embodiment.

FIGS. 11 and 12 show a liquid droplet ejecting apparatus 2 according to a fifth embodiment. The present embodiment is another modification example of the liquid droplet ejecting apparatus 2 according to the first embodiment (refer to FIGS. 1 to 7). Additionally, in the fifth embodiment, the same portions as those of the above-mentioned first embodiment will be described with the same reference numerals, and detailed description thereof will be omitted.

In the first embodiment, the solution containers 22 and the electric substrates 23 are fixed to the base member 21 as a support member of the solution containers 22 of the liquid droplet ejecting apparatus 2. Instead, in the fifth embodiment, an electric substrate 301 is used as a support member of the solution containers 22 of the liquid droplet ejecting apparatus 2, and the solution containers 22 are fixed to the electric substrate 301. That is, the liquid droplet ejecting apparatus 2 according to the present embodiment does not include the base member 21 of the first embodiment.

As shown in FIGS. 11 and 12, the electric substrate 301 includes a first surface 301*a* on which the solution is discharged from the nozzles 110, and a second surface 301*b* on which the solution is supplied to the solution containers 22. Furthermore, rectangular openings 301*c*, which have a larger diameter than the openings 22*a* of the solution containers 22, are formed on the electric substrate 301. The liquid droplet ejection arrays 27, which are fixed to the lower surfaces of the solution containers 22, are disposed in the openings 301*c*.

As shown in FIG. 11, each piece of electric substrate wiring 324, which is connected to the driving elements 130 of the liquid droplet ejection arrays 27, is formed on the rear surface (the first surface 301*a*) of the electric substrate 301. An input terminal 325 for inputting a control signal from an external device is formed at one end of the electric substrate wiring 324. An electrode terminal connection portion 326 is provided at the other end of the electric substrate wiring 324.

Each piece of wiring (the wiring portion 131*b* and the lower electrode terminal 131*c* of the lower electrode 131, and the wiring portion 133*b* and the upper electrode terminals 133*c* of the upper electrode 133) that is connected to the driving elements 130 of the liquid droplet ejection arrays 27 is included in the electric substrate wiring 324. Further, electrode terminal connection portions 326 of the electric substrate wiring 324, and the terminal portion 131*c* of the lower electrode 131 and two terminal portions 133*c* of the upper electrode 133 of the liquid droplet ejection array 27 are connected using wiring 312.

According to the liquid droplet ejecting apparatus 2 of the fifth embodiment, in the same manner as the first embodiment, each piece of wiring that is connected to the driving elements 130 of the liquid droplet ejection arrays 27, is disposed on a surface (the first surface 301*a* or a lower surface side) of the electric substrate 301 that is opposite to a surface (the second surface 301*b*) on which the solution containers 22 is fixed.

Also, the electric substrate wiring 324 is formed on a lower surface of the electric substrate 301. For that reason, the solution is less likely to be adhered to the electric substrate wiring 324 of the electric substrate 301 even if the solution spills over from the solution containers 22. As a result, it is possible to prevent corrosion of the wiring and an electrical short that are caused by the solution being adhered to the electric substrate wiring 324 or the like. Accordingly, it is possible to provide a liquid droplet ejecting apparatus with a high degree of safety.

Furthermore, according to the liquid droplet ejecting apparatus 2 of the fifth embodiment, the electric substrate 301 serves as the support body of the solution containers 22, and the base member 21 of the first embodiment is not included. For that reason, the liquid droplet ejecting apparatus 2 can be manufactured by simply fixing the solution containers 22 and the liquid droplet ejection arrays 27, and the solution containers 22 and the electric substrate 301. Since it is possible to omit the fixing of the base member 21 and the other members required in the first embodiment, the manufacturing process would become simpler compared to the first embodiment. In addition, since the base member 21 of the first embodiment is not necessary, manufacturing cost would become lower.

Sixth Embodiment

Figure 13:
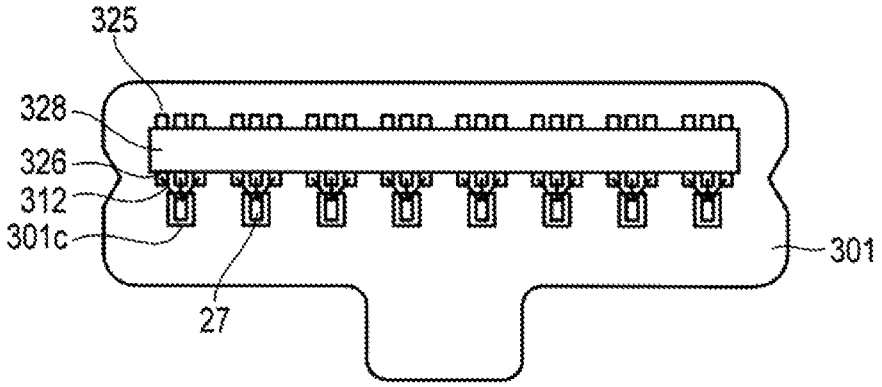
FIG. 13 is a plan view of a lower surface of a liquid droplet ejecting apparatus according to a sixth embodiment.
Figure 14:
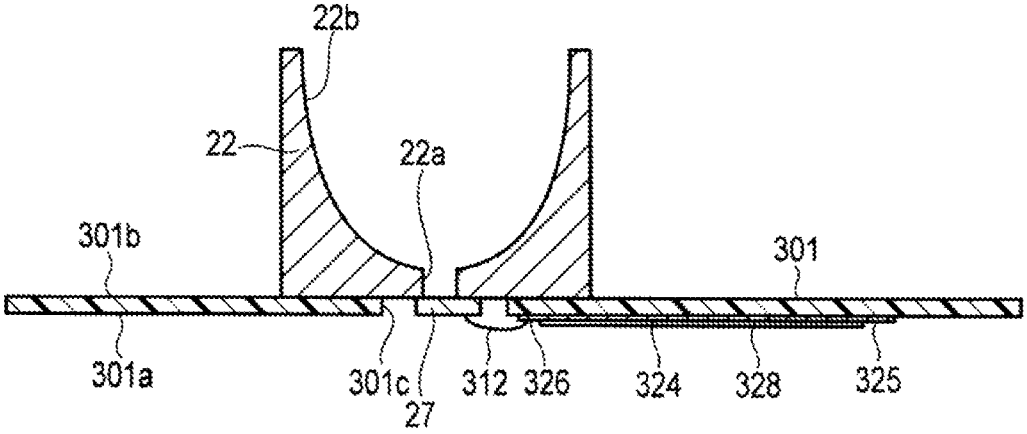
FIG. 14 is a cross-sectional view of the liquid droplet ejecting apparatus according to the sixth embodiment.

FIGS. 13 and 14 show a liquid droplet ejecting apparatus 2 according to a sixth embodiment. The present embodiment is a modification example of the liquid droplet ejecting apparatus 2 of the fifth embodiment (refer to FIGS. 11 and 12). In the sixth embodiment, the same portions as those of the fifth embodiment will be described with the same reference numerals, and detailed description thereof will be omitted.

In the liquid droplet ejecting apparatus 2 of the sixth embodiment, an insulation layer 328 is formed above the electric substrate wiring 324 except for an input terminal 325 and the electrode terminal connection portion 326. For example, the material of the insulation layer 328 is a solder resist, and a later of the solder resist is patterned using a photoresist to form the insulation layer 328.

According to the sixth embodiment, in the same manner as the first embodiment, in the liquid droplet ejecting apparatus 2, each piece of wiring connected to the driving elements 130 of the liquid droplet ejection arrays 27, is disposed on a surface (the first surface 301*a* or a lower surface) of the electric substrate 301 that is opposite to a surface (the second surface 301*b*) on which the liquid container 22 is fixed to the electric substrate 301.

Also, the input terminal 325 and the electrode terminal connection portion 326 are formed on a lower surface of the electric substrate 301. For that reason, the solution is not likely to be adhered to the input terminal 325 and the electrode terminal connection portion 326 of the electric substrate 301 even if the solution spills over from the solution containers 22. As a result, it is possible to prevent corrosion of the wiring as a result of the solution being adhered to the input terminal 325 of the electric substrate 301. Accordingly, it is possible to provide a liquid droplet ejecting apparatus with a high degree of safety.

Furthermore, in the liquid droplet ejecting apparatus 2 of the sixth embodiment, the insulation layer 328 is formed above the electric substrate wiring 324 except for the input terminal 325 and the electrode terminal connection portion 326. Therefore, oxidation of the electric substrate wiring 324 is suppressed in comparison with the first embodiment. In addition, the insulating properties are improved between adjacent wiring.

In the embodiments described above, the driving element 130 has an annular shape, but the shape of the driving section is not limited. For example, the shape of the driving section may be a rhombus-shape, may be an ellipse, or the like. In addition, the pressure chamber 210 may not be circular, and may be rhombus-shaped, elliptical, rectangular, or the like.

In addition, in the above embodiments, each of the nozzles 110 is disposed in the center of the corresponding driving element 130, but as long as the nozzle 110 is capable of discharging the solution from the pressure chamber 210, the position of the nozzle 110 is not limited. For example, instead of being within a region of the driving element 130, the nozzle 110 may be formed outside the driving element 130. When the nozzle 110 is disposed outside the driving element 130, it is not necessary to perform patterning of the plurality of film materials of the driving element 130 to form the nozzles 110. That is, the nozzles 110 can be formed by only patterning of the vibration plate 120 and the protective film 150.

According to at least one of the embodiments described above, it is possible to provide a liquid droplet ejecting apparatus that can prevent corrosion of the electric substrate wiring 24 and 324 and an electrical short that is caused by the solution being adhered to the electric substrate wiring 24 and 324 or the like, because the solution that has spilt over from the solution containers 22 is less likely to be adhered to the electric substrate wiring 24 and 324 that is connected to the driving element 130.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid droplet ejecting apparatus, comprising:

a liquid container having an upper opening that is open to an outside of the liquid droplet ejecting apparatus for receiving liquid and a lower opening through which the liquid is supplied, the lower opening being smaller than the upper opening;

a liquid ejection chip that is fixed to a lower surface of the liquid container to receive liquid from the liquid container, and includes a pressure chamber formed therein, a nozzle to eject liquid from the pressure chamber, and an actuator disposed adjacent to the nozzle;

a base member having an opening at which the liquid container is fixed such that the nozzle is exposed on a lower surface of the base member;

a circuit substrate fixed to a lower side of the base member and including a wiring electrically connected to the actuator on a lower surface of the circuit substrate; and wherein the upper opening of the liquid container remains open during operation of the liquid droplet ejecting apparatus.

2. The liquid droplet ejecting apparatus according to claim 1, wherein the base member has a recessed region on the lower side thereof, and at least part of the circuit substrate is fit in the recessed region.

3. The liquid droplet ejecting apparatus according to claim 1, wherein the liquid ejection chip further includes electrode terminals of the actuator exposed on a lower surface thereof, and the wiring is electrically connected to the electrode terminals.

4. The liquid droplet ejecting apparatus according to claim 1, wherein the wiring is exposed on the lower surface of the circuit substrate.

5. The liquid droplet ejecting apparatus according to claim 1, wherein at least part of the wiring is covered with an insulating layer formed on the circuit substrate.

6. The liquid droplet ejecting apparatus according to claim 1, wherein an opening of the pressure chamber is entirely included in an area of the lower opening of the liquid container to supply the liquid to the liquid ejection chip.

7. The liquid droplet ejecting apparatus according to claim 6, wherein the liquid ejection chip includes a plurality of pressure chambers within the area of the lower opening of the liquid container.

8. The liquid droplet ejecting apparatus according to claim 1, wherein a surface portion of the liquid ejection chip in which the nozzle is formed includes a vibration plate, a piezoelectric element disposed outside the vibration plate, and a protection film covering the piezoelectric element.

9. The liquid droplet ejecting apparatus according to claim 1, wherein the upper opening has a circular shape and the lower opening has a quadrangle shape.

10. The liquid droplet ejecting apparatus according to claim 1, wherein the liquid container includes a portion having a funnel-like inner shape.

11. The liquid droplet ejecting apparatus according to claim 10, wherein the liquid container has an upper portion having the funnel-like inner shape and a lower portion having a reverse taper shape.

* * * * *